United States Patent [19]

Rittenhouse et al.

[11] Patent Number: 4,929,470

[45] Date of Patent: May 29, 1990

[54] METHOD OF MAKING DECORATIVE CAST-COATED PAPER

[75] Inventors: David A. Rittenhouse, Midlothian; Fred Neurohr, Richmond; Doug R. Estridge, Midlothian, all of Va.

[73] Assignee: James River Corporation, Richmond, Va.

[21] Appl. No.: 315,159

[22] Filed: Feb. 24, 1989

[51] Int. Cl.[5] ..... B05D 3/06

[52] U.S. Cl. ..... 427/55; 427/362; 427/366; 427/428; 428/537.5

[58] Field of Search ..... 427/361, 362, 365, 366, 427/428, 55; 428/537.5

[56] References Cited

U.S. PATENT DOCUMENTS

| | | | |
|---|---|---|---|
| 322,034 | 7/1885 | Beck . | |
| 342,315 | 5/1886 | Beck . | |
| 3,982,056 | 9/1976 | Holder, Jr. | 427/361 |
| 4,048,380 | 9/1977 | Blakey et al. | 428/511 |
| 4,241,143 | 12/1980 | Ashie et al. | 428/512 |
| 4,265,969 | 5/1981 | Yasuda et al. | 428/342 |
| 4,515,833 | 5/1985 | Nojima et al. | 427/362 |
| 4,567,098 | 1/1986 | Becker et al. | 428/327 |

*Primary Examiner*—Michael Lusignan

*Attorney, Agent, or Firm*—Finnegan, Henderson, Farabow, Garrett and Dunner

[57] ABSTRACT

A method of making decorative cast-coated paper including particulate matter (such as flock, fiber or metal flake) in the coating, in which the particulate matter is added to the coating prior to the application of the coating to the paper, and cast on a casting drum.

16 Claims, 2 Drawing Sheets

METHOD OF MAKING DECORATIVE CAST-COATED PAPER

BACKGROUND OF THE INVENTION

The present invention relates to a method for producing decorative cast-coated papers having the appearance of decorative, uncoated papers, yet also having superior gloss and printability characteristics over uncoated papers. More specifically, the invention relates to the inclusion of flock or other particles in the coating to provide the desired decorative appearance.

The method of manufacturing undecorated cast-coated papers is well known in the art, and several variations have been employed by different artisans. All methods, however, employ certain basic steps. A paper web is passed over rollers or other coating means imparting a wet coating to one side of the paper. The wet, coated side is then passed over a heated calendering roll or cast drum, which is polished to provide a smooth casting surface and to impart a smooth finish to the cast-coated paper. Such a heated roll may be, for example, a polished chromium roll. The heated roll dries the coating on the paper, leaving the image of the smooth surface of the polished roll on the coated side of the paper. Cast-coated papers produced by this method and its variations are characterized by superior gloss properties and superior printing surfaces on the coated side. Cast-coated papers therefore also result in a superior aesthetic appeal as compared to uncoated papers.

Uncoated papers often include, for aesthetic effect, fibers, metal flakes, flock or other particles dispersed in or paper. Thus, in Beck, U.S. Pat. No. 342,315, particulate matter such as flock, tinsel, and metallic powders were applied to the surface of paper by application of mechanical pressure to embed the particles in the surface of the paper. Likewise, in Beck, U.S. Pat. No. 322,034, particles were added to paper pulp to produce desired aesthetic effects.

The coating of such papers has not proved to be desirable or efficient, though in Beck, U.S. Pat. No. 322,034, the now obsolete method of brush coating after embedding of the particles is described. Moreover, since the coatings used in the cast-coating process are somewhat opaque, coating after inclusion of particulate matter in the paper diminishes the aesthetically appealing effects achieved by inclusion of the particles in the paper. Furthermore, such particles are dispersed throughout the thickness of the paper, and do not merely appear on the surface of the paper. As a result, it is prohibitively expensive to cast-coat uncoated paper that includes particulate matter.

Metallized coated papers, such as that described in Becker et al., U.S. Pat. No. 4,567,098 are also known in the art. According to Becker et al., a metal layer is deposited upon a cast-coated paper by evaporation in vacuo. This process produces a highly polished metal surface, and does not produce a surface having flakes of metal or other particulate matter, and a different aesthetic effect is accomplished.

The inclusion of flock, fibers, metal flakes and other particulate matter in cast-coated paper has not been known in the art. Although it is known in the art that pigments may be included in the coating, it has not been known that flock, fibers, metal flakes or other particulate matter may be included in the coating to produce the desired aesthetic effects, while retaining the superior printability characteristics found generally in cast-coated papers. Cast-coated papers including flock or other particulate matter, and maintaining superior printability characteristics, may be used in conjunction with uncoated papers to produce especially desirable aesthetic effects.

SUMMARY OF THE INVENTION

In view of the foregoing, the present invention is directed to a method of making a cast-coated paper including flock, fibers, metal flakes or other particulate matter in the coating. Furthermore, the present invention is directed to a method of making such a cast-coated paper including particulate matter, while retaining superior gloss and printability characteristics.

The present invention is a method for making a decorative cast-coated paper including particulate matter in the coating, comprising the steps of preparing a coating including particulate matter, coating a paper web with the coating, and casting the coating by passing the coated paper around a casting drum.

The present invention also includes cast-coated paper made by this method.

The foregoing and other objects, features and advantages of the present invention will be made more apparent from the following description of the preferred embodiments.

DETAILED DESCRIPTION OF THE INVENTION

Figure 1:
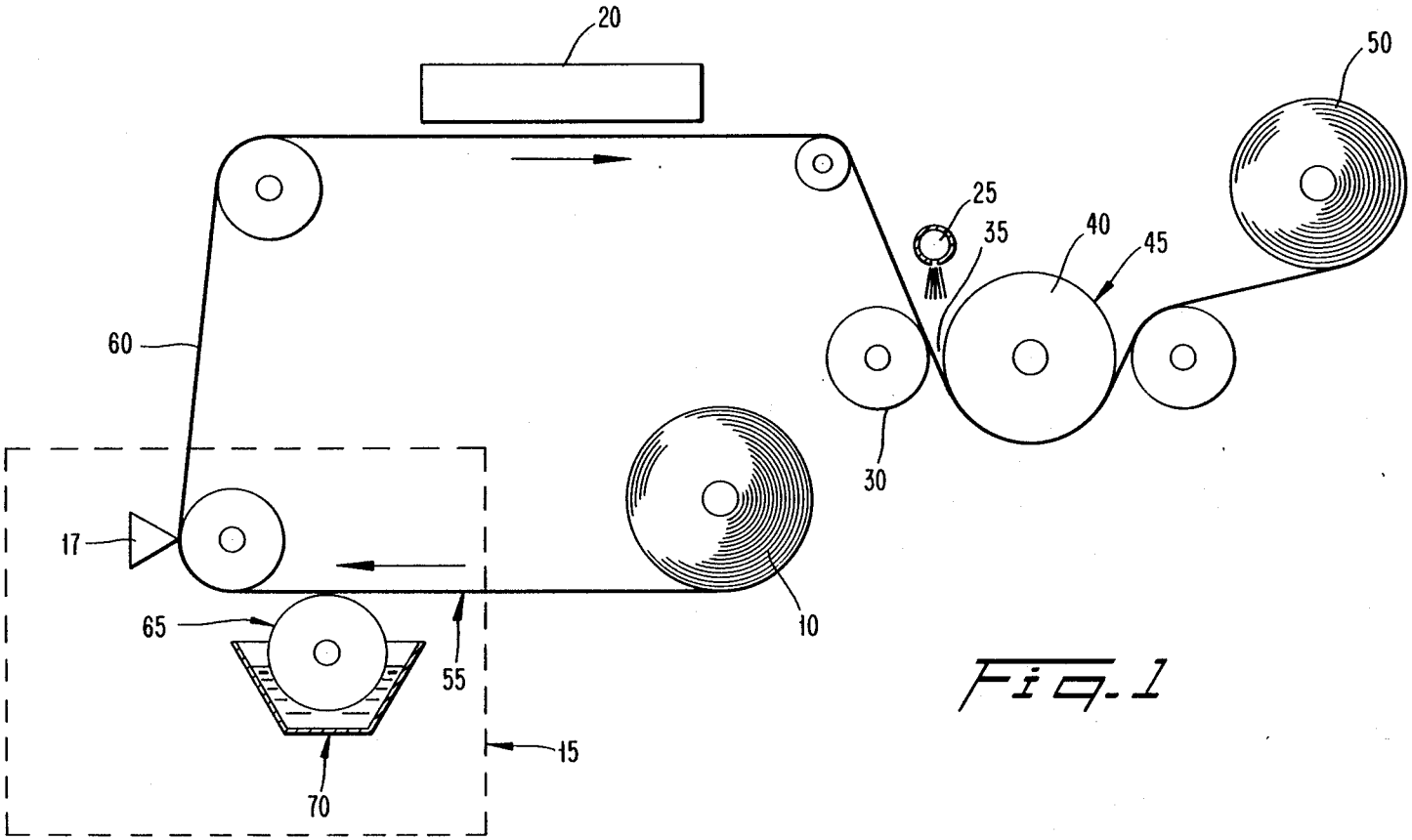
FIG. 1 illustrates several steps in the method of producing cast-coated paper including particulate matter, according to the present invention, using a gellation/-rewetting coating process.

Reference will now be made in detail to present preferred embodiments of the invention.

Coatings for cast-coating paper are known in the art. In the present invention, it is preferable to use a coating which includes casein and other binders, and pigment. Other binders, such as synthetic binders or protein and synthetic binders, may also be used in coatings and are known in the art. The binder may desirably be present in the coating in quantities from 5–50 percent of the coating solids, and the pigment may desirably be present in quantities from 30–90 percent of the coating solids.

Coatings, such as those described above, are ordinarily filtered several times to remove impurities, inasmuch as it is desirable to provide a smooth and impurity-free coated finish to papers. According to the present invention, it is possible to avoid those filtering steps in which fine impurities are removed. Such fine impurities are not deleterious to the aesthetic and other effects of the present invention, and may be said to enhance those effects. Filtration may optionally be performed in the method according to the present invention, however, the coating must be filtered prior to the addition of the particulate matter according to the present invention.

Particulate matter, such as flock, metal flake, fibers, and similar materials, is added to the coating prior to application of the coating to the paper web. The particulate material is mixed with the coating material to be, preferably, evenly dispersed throughout said coating material. It is possible, but not desirable, to add as the particulate matter materials having a hardness greater than the hardness of the polished material on the casting drum, or other abrasive materials. These include, for example, sand, silica, and diatomaceous earth, among others. Particles of these materials tend to abrade and otherwise spoil the polished surface of the casting drum, necessitating frequent replacement at substantial cost.

Although precise limits on the amount of particulate matter will vary depending upon the type of particulate matter used, quantities ranging from about 0.5 percent to about 4.0 percent by weight of particulate matter relative to weight of wet coating material have been used in accord with the present invention. Where the particulate matter is flock, for instance, it has been determined that a content of about two percent by weight of flock per weight of wet coating material achieves preferred aesthetic and printability characteristics. It is believed that when undesirably high quantities of particulate matter are added to the coating, deleterious effects such as "picking out" (removal of the particulate matter from the coating) may occur during printing or other processing.

In the embodiment of the present invention in which the particulate matter employed is flock, it is necessary that the flock contain sufficient moisture to permit easy dispersion in the coating. Accordingly, "dry" flock containing only ambient moisture is preferably not used in the present process. Flock having about 50 percent moisture has been successfully employed in the process according to the present invention.

Also pertaining to the use of flock as the particulate matter in the method of the present invention, it has been found that cotton, rayon and other synthetic fibers may be successfully included the the coating. Where the flock used is cotton flock, it has been preferable to use cotton linters of naturally occuring diameter and length. The use of rayon or other synthetic fibers requires that the fibers be made and cut to desired diameters and lengths.

Referring now to FIG. 1, the coating, including particulate matter, is applied to a continuous paper web 55 from paper supply roll 10 manufactured according to processes known in the art, by coating means 15, to produce a coated paper. The coating means preferably comprise an air knife 17, which is known in the art to include a coating applicator roll 65 with the coating being supplied from a coating applicator pan 70. Various configurations of coating applicator rolls are known to those skilled in the art and may be employed in the method according to the present invention. Coating methods such as blade coating and gravure coating, however, are considered undesirable in view of a tendency for any undispersed particulate matter to agglomerate and prevent proper flow of coating material through the coating means onto the paper web.

The coated paper 60 is next passed through or near heating means 20 to gel the coating on the paper. The heating means preferably comprise an infrared heater. The moisture content of the gelled coating may be from 5 to 55 percent of the moisture content of the coating before gelling.

The coated paper 60, the coating now being gelled, is next passed into a nip 35 between a nip roll 30 and a casting drum 40. The loading pressure at the nip is typically from 5–1000 pounds per liner inch. Such casting drums are known in the art and may, for example, comprise a heated drum having a highly polished surface 45. The use of a highly polished chromium surface on the casting drum has been found particularly advantageous. The casting drum may desirably be heated to a temperature of between 180–380 degrees Fahrenheit.

Hot water, known as rewetting water, is supplied continuously through water-suppling means 25 (e.g., a nozzle) to nip 35 for the purpose of rewetting (i.e., being absorbed into and plasticizing) the coating. This rewetting water should be heated to a temperature of slightly less than 100° C. This rewetting water is then removed from the coating as coated paper 60 is passed around the heated casting drum, and collected on a take-up roll 50.

Figure 2:
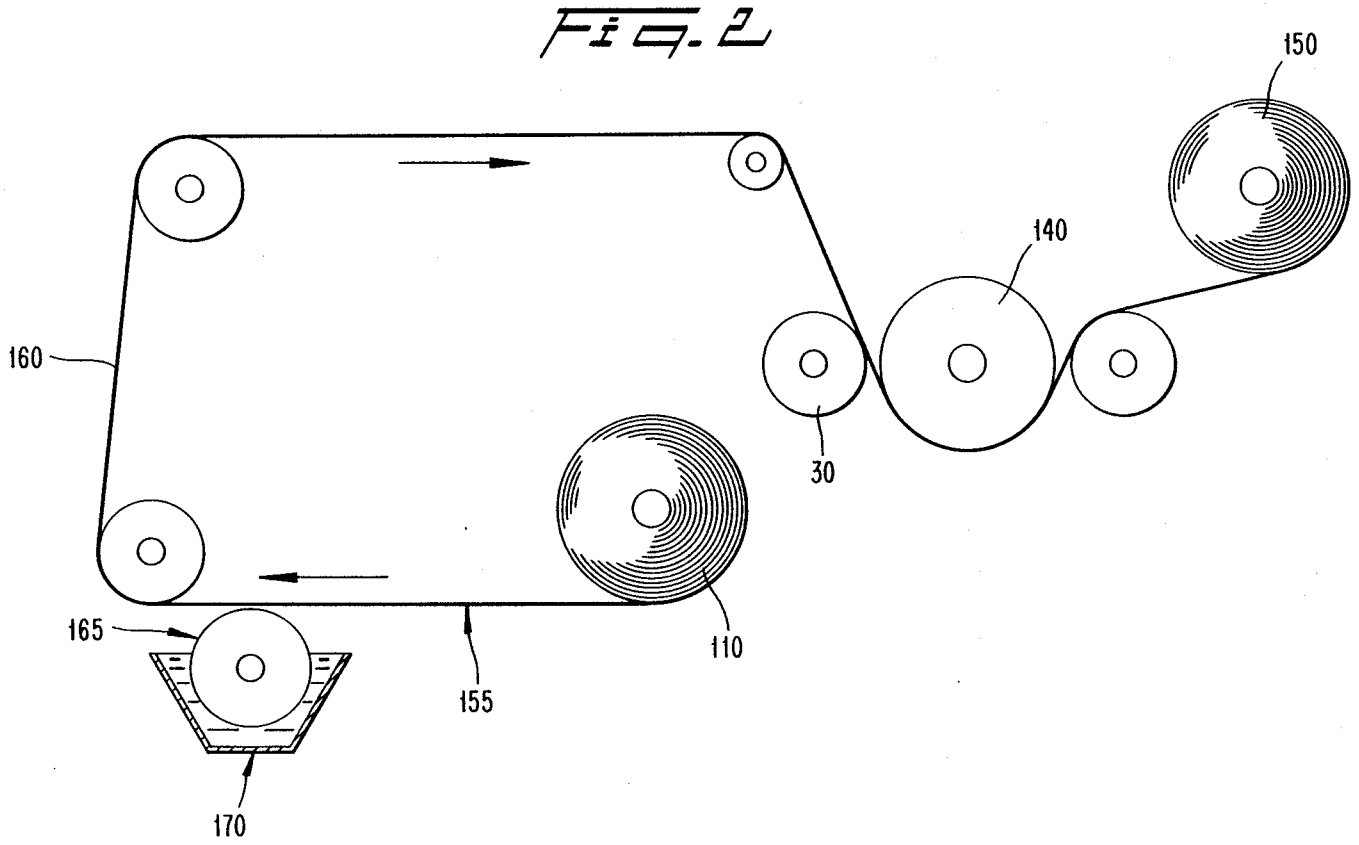
FIG. 2 illustrates several steps in the method of producing cast-coated paper including particulate matter, according to the present invention, using a wet coating process.

Alternatively, the coating (including particulate matter) may be employed using a wet coating process. According to that process, and referring now to FIG. 2, the coating is applied to web 155 from paper supply roll 110 by a coating applicator roll 165, the coating being supplied from a coating applicator pan 170. The coated paper 160 is then passed around casting drum 140 wherein the coating is cast and dried. The resulting coated paper is collected on takeup roll 150. This method of coating may be substituted for the method method described above without appreciable differences in the aesthetic or other effects of the invention.

The cast-coated paper, including particulate matter in the coating, which results from the process set forth above, has desirable aesthetic and printability characteristics. For instance, cast-coated paper according to the present invention has the superior printability characteristics of ordinary cast-coated papers (which do not include particulate matter in the coating), while at the same time having the desirable aesthetic effect previously found only in uncoated papers. Cast-coated papers made according to the present invention are also produced at a substantially reduced expense as compared to a process of merely coating uncoated papers including particulate matter (e.g., flocked uncoated paper). Moreover, merely coating such uncoated papers diminishes the aesthetic qualities of those papers as compared to papers produced according to the present invention, since the opacity of the coating tends to obscure the particulate matter included in the uncoated paper.

Although the present invention has been described in terms of specific embodiments, it will be apparent to one skilled in the art that various modifications may be made to those embodiments without departing from the scope of the appended claims and their equivalents. Accordingly, the present invention should not be construed to be limited to the specific embodiments disclosed herein.

What is claimed is:

1. A method for making a decorative cast-coated paper including particulate matter in the coating, comprising the steps of:

preparing a coating including an effective amount of particulate matter selected from the group consisting of flock, fiber, and metal flake;

coating a paper web with the coating; and casting the coating by passing the coated paper around a casting drum.

2. The method of claim 1 wherein the step of coating the paper further comprises the steps of gelling said coating to create a coated paper; passing the coated paper through a nip between a nip roll and the casting drum; and flooding the nip with heated rewetting water prior to casting.

3. The method of claim 1 wherein the step of coating the paper further comprises passing the paper web over a coating applicator roll.

4. The method of claim 2, wherein the paper web is coated with a coating supplied by an air knife.

5. The method of claim 1, wherein the particulate matter is flock.

6. The method of claim 5, wherein the moisture content of the flock is about 50 percent.

7. The method of claim 1, wherein the amount particulate matter included in the coating is between about 0.5 percent by weight particulate matter per weight of wet coating material, and 4 percent by weight particulate matter per weight of wet coating material.

8. The method of claim 2, wherein a heating means is used to gel the coating.

9. The method of claim 8, wherein the heating means comprises an infrared heater.

10. A method for making a decorative cast-coated paper including particulate matter in the coating, comprising the steps of:

preparing a coating including an effective amount of particulate matter selected from the group consisting of flock, fiber and metal flake;

coating a paper web with said coating using an air knife;

gelling said coating using an infrared heater to create a coated paper;

passing the coated paper through a nip between a nip roll and a heated casting drum;

flooding the nip with heated rewetting water; and casting the coating by passing the coated paper around the casting drum.

11. The method of claim 10, wherein the amount of particulate matter included in the coating is between about 0.5 percent by weight particulate matter per weight of wet coating material, and 4 percent by weight particulate matter per weight of wet coating material.

12. A decorative cast-coated paper including particulate matter made according to the method of claim 1.

13. A decorative cast-coated paper including particulate matter made according to the method of claim 2.

14. A decorative cast-coated paper including particulate matter made according to the method of claim 5.

15. A decorative cast-coated paper including particulate matter made according to the method of claim 10.

16. A decorative cast-coated paper including particulate made according to the method of claim 11.

* * * * *

UNITED STATES PATENT AND TRADEMARK OFFICE

CERTIFICATE OF CORRECTION

PATENT NO. : 4,929,470

DATED : May 29, 1990

INVENTOR(S) : David A. Rittenhouse, et al

It is certified that error appears in the above-identified patent and that said Letters Patent is hereby corrected as shown below:

On title page, item [75],

"Doug R. Estridge" should read --Ronald D. Estridge--

Signed and Sealed this

Ninth Day of March, 1993

*Attest:*

STEPHEN G. KUNIN

*Attesting Officer*

*Acting Commissioner of Patents and Trademarks*